United States Patent [19]

Lee et al.

[11] Patent Number: 4,476,852

[45] Date of Patent: Oct. 16, 1984

[54] ADD-ON CATALYTIC DAMPER ASSEMBLY

[76] Inventors: Jonathan P. Lee; Clyde L. Logue, both of P.O. Box 188, Flint Hill, Va. 22627

[21] Appl. No.: 447,271

[22] Filed: Dec. 6, 1982

[51] Int. Cl.[3] ..... F23V 15/00; F23L 11/00

[52] U.S. Cl. ..... 126/289; 126/285 R; 126/292; 110/203; 422/177

[58] Field of Search ..... 126/285 R, 289, 290, 126/291, 292, 312, 307 R; 110/203, 210, 208, 209, 214; 422/174, 177, 200

[56] References Cited

U.S. PATENT DOCUMENTS

| | | | |
|---|---|---|---|
| 89,179 | 4/1869 | Spear | 126/292 |
| 4,191,171 | 3/1980 | Primeau | 126/292 |
| 4,319,556 | 3/1982 | Schwartz et al. | 126/289 |
| 4,373,452 | 2/1983 | VanDewoestine | 110/203 |
| 4,373,507 | 2/1983 | Schwartz et al. | 110/203 |

*Primary Examiner*—James C. Yeung
*Attorney, Agent, or Firm*—Larson and Taylor

[57] ABSTRACT

An add-on catalytic damper assembly is provided which is adapted to be positioned between the flue outlet pipe of a wood burning stove and the chimney pipe, and which provides catalytic combustion of the normally unburned portions of the flue gas. The assembly is of a very simple five part construction comprising upper and lower housing members adapted to be connected to the chimney and stove pipes, respectively; a plate nestingly mounted within the lower housing member and including a pair of side by side openings therein providing two paths for the flue gas; a catalytic converter mounted in one of the openings; and a damper plate mounted over the other opening and movable by means of an integral handle between blocking and unblocking positions.

7 Claims, 3 Drawing Figures

FIG. 2
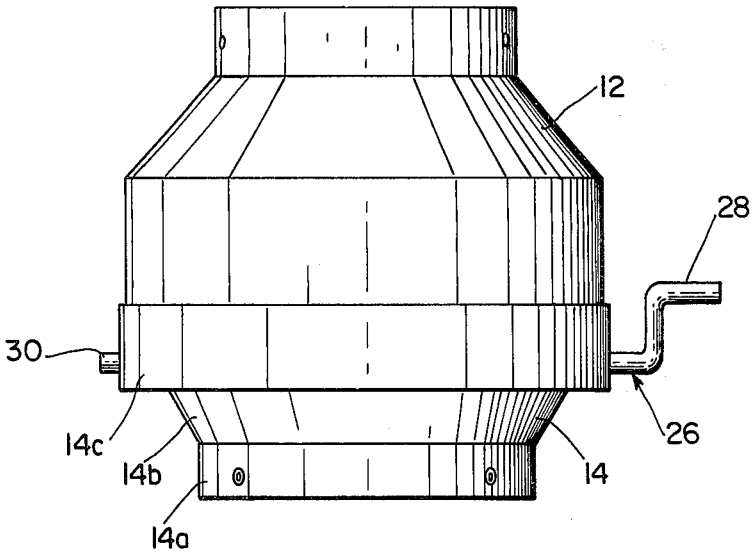
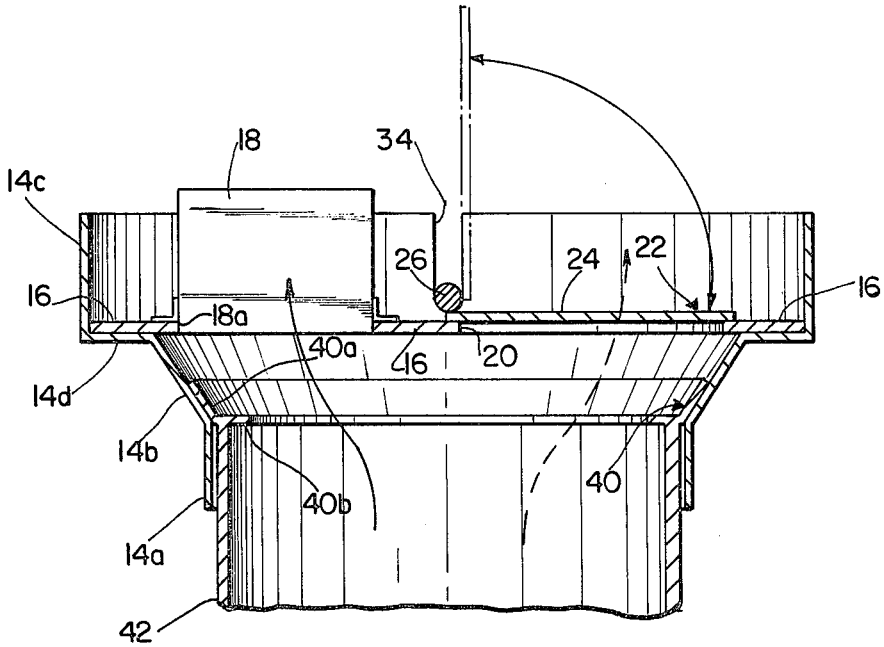
FIG. 3

ADD-ON CATALYTIC DAMPER ASSEMBLY

FIELD OF THE INVENTION

The present invention relates to catalytic converters for wood stoves and, more particularly, to an add-on assembly which incorporates a catalytic converter and is adapted to be added on to an existing stove.

BACKGROUND OF THE INVENTION

Catalytic wood stoves have been receiving substantial attention because of their increased combustion efficiencies and heating efficiencies. Reference is made, for example, to Powell, "Catalytic Wood Stoves," *Popular Science,* January 1982, pp 77–79. Examples of such stoves are disclosed in U.S. Pat. Nos. 4,319,556 (Schwartz et al); 4,330,503 (Allaire et al); and 4,345,528 (Allaire et al). The first-mentioned Allaire et al patent discloses a wood burning stove including a catalytic converter in combination with a bypass damper while the latter patent discloses a catalytic converter device, located in the flue of a wood burning stove, which is movable so that the impedance presented to the exhaust may be selectively varied.

A basic disadvantage of wood stoves of the prior art which incorporate catalytic converter or combustor devices either in the stove itself or in the flue thereof is their relative complexity. Such stoves can be relatively difficult, and hence expensive, to manufacture as well as to assemble and disassemble.

SUMMARY OF THE INVENTION

In accordance with the invention, an add-on catalytic assembly is provided which is adapted to be inserted between the flue outlet of a wood burning stove and the chimney pipe for the stove as an in-line component in the path of the flue exhaust. The assembly is simple in construction and comprises five basic components which are extremely easy to assemble and disassemble. This feature enables the assembly to be readily installed with an existing stove and in addition, provides for rapid disassembly to permit easy replacement of the catalytic converter as well as for cleaning purposes.

According to a preferred embodiment, the catalytic converter assembly comprises an upper housing member including an upper connecting sleeve for connection to a chimney pipe and an enlarged housing portion; a lower housing member including a lower connecting sleeve for connection to a flue outlet of a stove and an enlarged housing portion which cooperates with the enlarged housing portion of the upper housing member to define a housing; a mounting plate mounted within the housing and seated in the lower housing member on a support surface defined by the lower housing member, the mounting plate including a pair of openings formed therein in side by side relation; a catalytic converter mounted in registration with one of the openings so that flue gases passing through that opening pass through the catalytic converter; and a damper member, comprising a damper plate and an integral control handle, mounted within the housing and rotatable between a first position wherein the damper plate blocks the other opening in the support plate and a second position wherein the opening is unblocked, the upper edge of the lower housing member including a pair of diametrically opposed recesses therein and the outboard ends of the control handle of the damper member being seated in the recesses in the lower housing member such that the control handle is captured between the upper and lower housing members and supported for rotation therebetween.

Advantageously, the upper housing member includes corresponding recesses in the lower edge thereof which register with the recesses in the lower housing member. Further, the lower housing member preferably includes a substantially flat, horizontally extending wall portion which forms the aforesaid support surface of the lower housing member. In addition, the damper plate preferably includes a straight edge portion and the control handle is secured to this straight edge portion. In accordance with a further feature, the housing member includes inwardly extending abutment means for limiting the distance the outlet flue pipe of a stove can extend into the assembly. This feature provides appropriate spacing between the flue outlet and the catalytic converter and prevents a long outlet pipe from extending too great a distance into the housing.

In a specific advantageous embodiment, the connecting sleeve portions of the housing members are both cylindrical in shape and the upper and lower housing members both include frusto-conical portions located between the respective connecting sleeves and enlarged portions thereof. The support surface referred to above is formed between the frusto-conical and enlarged portions of the lower housing member. In this embodiment, the abutment means referred to above comprises a support rim which is secured to the frusto-conical portion of the lower housing member and which extends inwardly therefrom to form a abutment surface for the upper edge of the outlet flue pipe of the stove with which the assembly is used.

Other features and advantages of the present invention are set forth in or will be apparent from, the detailed description of a presently preferred embodiment of the present invention found hereinbelow.

BRIEF DESCRIPTION OF THE DRAWINGS

FIG. 2 is a perspective view of the assembly of FIG. 1, taken from a different perspective and with the parts assembled; and FIG. 3 is a cross-sectional view of a catalytic damper assembly of the invention with the upper housing member removed.

DESCRIPTION OF A PREFERRED EMBODIMENT

Figure 1:
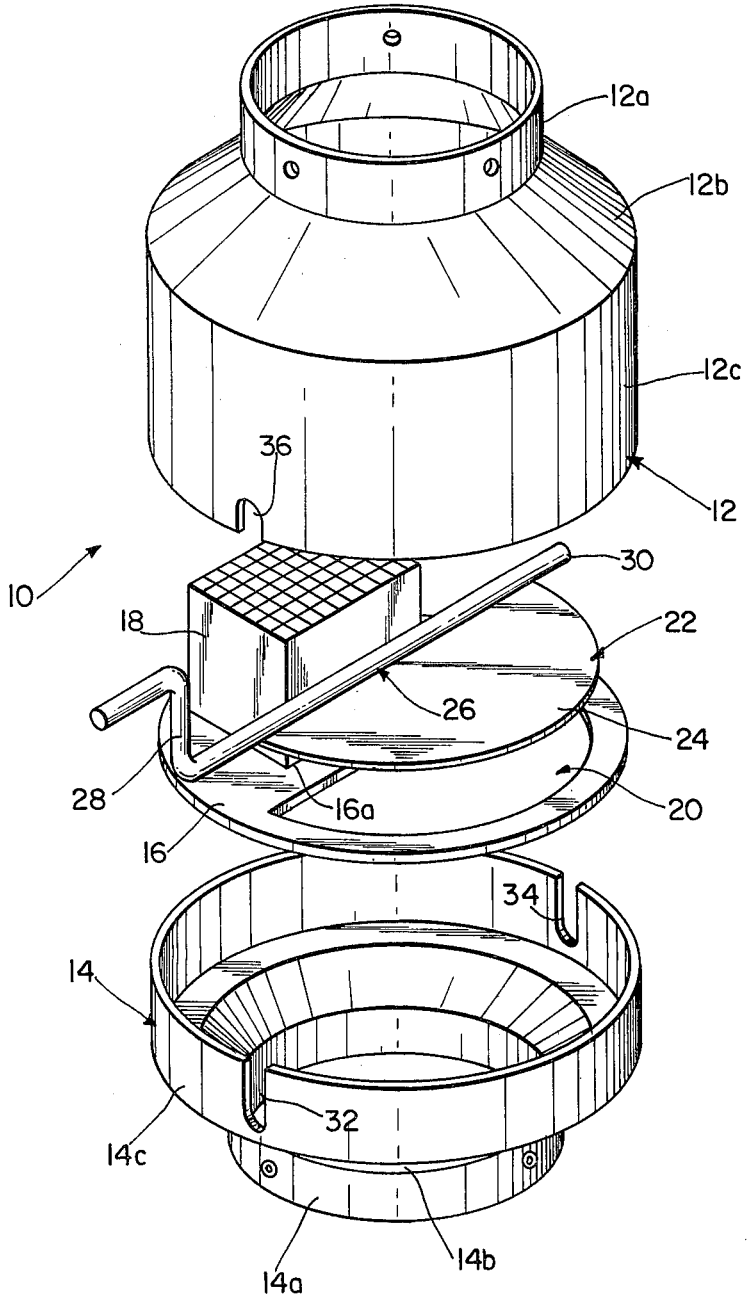
FIG. 1 is an exploded perspective view of an add-on catalytic damper assembly constructed in accordance with a preferred embodiment of the invention.

Referring particularly to FIGS. 1 and 2, a catalytic damper assembly constructed in accordance with a preferred embodiment of the invention is shown. As illustrated, the assembly, which is generally denoted 10, includes upper and lower housing members 12 and 14. Upper housing member 12 includes a short upper cylindrical sleeve **12*a* which is adapted to be attached to the stove pipe connection which extends through the roof or otherwise provides for outside exhaust of the smoke fumes from the stove with which the assembly is used. A lower cylinder portion 12*b* of housing member 12 is joined to upper connecting sleeve 12*a* by an intermediate frusto-conical portion 12*c***.

Similarly, lower housing member 14 includes a lower connecting sleeve **14*a*, a frusto-conical portion 14*b* and an upper cylindrical portion 14*c*. Additionally, as can be best seen in FIG. 3, a flat, support portion or ledge 14***d* is provided between portions 14*b* and 14*c*.

As shown in FIGS. 2 and 3, the assembly 10 also includes, as a third component thereof, a support plate 15 which carries a catalytic converter 18 mounted in a first aperture 18*a* therein and includes a second parallel aperture or opening 20 therein. As illustrated, catalytic converter 18 and aperture 20 are dispose in side by side relationship and, as discussed below, provide two paths through which smoke may travel. Catalytic converter 18 comprises a ceramic honeycomb or gridwork which forms a substrate to which a thin coating of a metallic catalyst is applied, and is mounted in opening 18*a* in plate 16 such that flue gases may pass therethrough. Plate 16 nests in lower housing member 14 and is seated on supporting ledge 14*d* as shown in FIG. 3.

A damper member 22 forms the fourth component of the assembly and comprises a damper plate 24 and an integral handle 26. Damper plate 24 is generally the shape of a semicircle so as to match opening 20 and handle 26 is attached thereto along the straight edge thereof. Handle 26 includes a generally L-shaped gripping portion 28 which extends out of the assembly 10 on one side while the straight distal end 30 extends out of the other. Portions 28 and 30 are received in respective recesses or slots 32 and 34 in the upper edge of housing member 14. Similar, shorter recesses or slots, only one of which, denoted 36, is shown, are formed in upper housing member 12. Thus handle 26 is captured between members 12 and 14 and mounted so as to permit rotation of damper plate 24 between an open position wherein exhaust fumes pass through opening 20 in plate 16 and a closed portion wherein opening 20 is blocked. This can perhaps be best seen in FIG. 3 which shows the closed position of damper plate 24 in solid lines and the open position in dashed lines. In the latter position, flue gas can flow both through converter 18 and opening 20.

Lower housing member 14 preferably includes a support rim 40 having a frusto-conical portion 40*a* secured to frusto-conical portion 14*b* of housing member 14 and a flat lip portion 40*b* which extends inwardly and, as shown in FIG. 3, provides a stop or abutment surface against which the flue outlet pipe 42 of a stove abuts so as to limit the distance to which pipe 42 extends into housing member 14.

Although the invention has been described relative to an exemplary embodiment thereof, it will be understood by those skilled in the art that variations and modifications can be effected in this exemplary embodiment without departing from the scope and spirit of the invention.

We claim:

1. A catalytic converter assembly for use in a wood burning stove and adapted to be disposed between the flue outlet of the stove and a chimney pipe for the stove, said assembly comprising:

an upper housing member including an upper connecting sleeve for connection to the chimney pipe and an enlarged housing portion;

a lower housing member including a lower connecting sleeve for connection to the flue outlet of the stove and an enlarged housing portion which cooperates with the enlarged housing portion of said upper housing member to define a housing;

a mounting plate mounted within said housing and seated in said lower housing member on a support surface defined by said lower housing member, said mounting plate including a pair of openings formed therein in side by side relation;

a catalytic converter mounted in registration with one of said openings so that flue gases passing through that opening pass through the catalytic converter; and a damper member, comprising a damper plate and an integral control handle, mounted within said housing and rotatable between a first position wherein said damper plate blocks the other opening in said support plate and a second position wherein said opening is unblocked, the upper edge of said lower housing member including a pair of diametrically opposed recesses therein and the outboard ends of said control handle of said damper member being seated in the recesses in said lower housing member such that the control handle is captured between the upper and lower housing members and supported for rotation therebetween.

2. An assembly as claimed in claim 1 wherein said upper housing member includes corresponding recesses in the lower edge thereof which register with the recesses in the lower housing member.

3. An assembly is claimed in claim 1 wherein said lower housing member includes a substantially flat horizontally extending wall portion which forms said support surface of said lower housing member.

4. An assembly as claimed in claim 1 wherein said damper plate includes a straight edge portion and said control handle is secured to said straight edge portion.

5. An assembly as claimed in claim 1 wherein said connecting sleeve portions of said housing members are both cylindrical in shape and said upper and lower housing members both include frustro-conical portions between the respective connecting sleeves and enlarged portions thereof.

6. An assembly as claimed in claim 5 wherein a support rim is secured to the frustro-conical portion of said lower housing member and extends inwardly therefrom to form an abutment surface for the upper edge of the outlet flue pipe of the stove with which the assembly is used.

7. An assembly as claimed in claim 1 wherein said housing member includes inwardly extending abutment means for limiting the distance the outlet flue pipe of a stove can extend into the assembly.

* * * * *